US005274192A

United States Patent [19]

Kumagai

[11] Patent Number: 5,274,192

[45] Date of Patent: Dec. 28, 1993

[54] INSTRUMENT FOR RECORDING AND PLAYING BACK MUSICAL PLAYING DATA

[75] Inventor: Tomoyuki Kumagai, Hamamatsu, Japan

[73] Assignee: Yamaha Corporation, Hamamatsu, Japan

[21] Appl. No.: 774,051

[22] Filed: Oct. 8, 1991

[30] Foreign Application Priority Data

Oct. 9, 1990 [JP] Japan ..... 2-271672

[51] Int. Cl.[5] ..... G10G 3/04; G10H 1/06

[52] U.S. Cl. ..... 84/601; 84/637; 84/DIG. 22; 84/DIG. 29; 84/462; 84/634

[58] Field of Search . 84/609-615, 634-638, 641-642, 649-653, 666-669, Dig29, 84-Dig22, 462, 601

[56] References Cited

U.S. PATENT DOCUMENTS 4,930,390 6/1990 Kellogg et al. ..... 84/611

4,981,066 1/1991 Kakizaki ..... 84/613

5,131,309 7/1992 Nishikawa et al. ..... 84/DIG. 29

*Primary Examiner*—William M. Shoop, Jr.

*Assistant Examiner*—Helen Kim

*Attorney, Agent, or Firm*—Graham & James

[57] ABSTRACT

An instrument for recording and playing musical playing data comprises a pattern memory, a timing designation key for designating playing back timing of the pattern data, a sequence track for recording sequence data, and a writing device for writing the pattern data into the sequence track at the playing back timing designated with the timing designation key. The pattern data is read from the pattern memory and transferred to the place, in the sequence track, corresponding to the designated timing. The transferred note data is modified with the designated chord. The instrument further comprises a backing track storing backing data, any part of which can be also transferred to the sequence track.

12 Claims, 20 Drawing Sheets (A)

| |
|---|
| BOH |
| 19 |
| 48 |
| 64 |
| AOH |
| 24 |
| BOH |
| 10 |
| 52 |

(B)

(A)

| |
|---|
| DOH |
| 1 |
| AOH |
| 48 |
| DOH |
| 2 |

(B)

| | |
|---|---|
| PATTERN 01 | PATTERN 02 |

| DG / TYPE | 1<br>0 | 1<br>1# | 2<br>2 | 3<br>2# | 4<br>3 | 5<br>4 | 6<br>4# | 7<br>5 | 8<br>5# | 9<br>6 | 10<br>6# | 11<br>7 |
|---|---|---|---|---|---|---|---|---|---|---|---|---|
| M | 0 | 0 | 0 | 0 | 0 | 0 | 0 | 0 | 0 | 0 | +2 | 0 |
| m | 0 | 0 | 0 | 0 | -1 | 0 | 0 | 0 | 0 | 0 | +2 | 0 |
| 7th | 0 | 0 | 0 | 0 | 0 | 0 | 0 | 0 | 0 | 0 | 0 | 0 |
| m7 | 0 | 0 | 0 | 0 | -1 | 0 | 0 | 0 | 0 | 0 | 0 | 0 |
| 6 | 0 | 0 | 0 | 0 | 0 | 0 | 0 | 0 | 0 | 0 | -1 | 0 |

TABLE(TYPE,DG)

Fig.7

INSTRUMENT FOR RECORDING AND PLAYING BACK MUSICAL PLAYING DATA

BACKGROUND OF THE INVENTION

1. Field of the invention

The present invention relates to an instrument for recording and playing back musical playing data in which playing musical playing data is recorded and played back, and more particularly, to an instrument for recording and playing back musical playing data in which grouped playing data is recorded as a pattern.

2. Description of the prior art

In conventional electronic musical instruments, such as sequencers, musical playing data is recorded as a pattern, thereby the recorded data can be played back when the pattern is designated by a number or the like. The recorded playing data is generally accompaniment data, having a length of several bars and consisting of portions of chords, bases, rhythms and so on. The sequencers have sequence tracks in which melody data or the like is recorded, playing data for one tone being recorded on the sequence tracks.

Automatic musical playing performed by designation of stored patterns allows a player easy operation, but has disadvantages in that musical data stored as a pattern can only be played back as recorded, with no modification. Also, using the sequence tracks enables a player's preferable melodies and accompaniments to be freely played back, but has disadvantages in that it is very laborious to write the preferable melodies into the sequence tracks. Further, writing of playing data similar to the stored patterns needs the sequence track, because if the playing data to be written is slightly different from the stored patterns, it is impossible to use the stored patterns. That is, it is necessary to write data for each tone into the sequence tracks, resulting in laborious operation.

SUMMARY OF THE INVENTION

It is therefore an object of the present invention to provide an instrument for recording and playing back musical playing data which is capable of transferring stored patterns from a pattern memory to a sequence track.

In accordance with the present invention, an instrument for recording musical playing data comprising pattern storage means for storing pattern data, timing designation means for designating play back timing of the stored pattern data, a sequence track for recording sequence data, and writing means for writing the pattern data into a designated location in the sequence track corresponding to the play back timing designated by the timing designation means.

Also in accordance with the present invention, an instrument for recording musical playing data comprising pattern storage means for storing pattern data, timing designation means for designating play back timing of the stored pattern data, a sequence track for recording sequence data, a backing track for recording backing data consisting of various types of part data, part type designation means for designating a type of the part data stored on the backing track, and writing means for writing the part data from the backing track, of the type designated by the part type designation means, into a location in the sequence track according to the play back timing designated by the timing designation means.

In the present invention, pattern data in the pattern storage means can be transferred to the sequence track, to a location in the sequence track corresponding to the designated timing, in detail. Also, part data in the backing track can be transferred to the sequence track. The transferred note data is modified with a designated chord.

BRIEF DESCRIPTION OF THE DRAWINGS

FIG. 7 is a table recorded in a table memory of the sequencer.

DETAILED DESCRIPTION OF THE PREFERRED EMBODIMENTS

Figure 1:
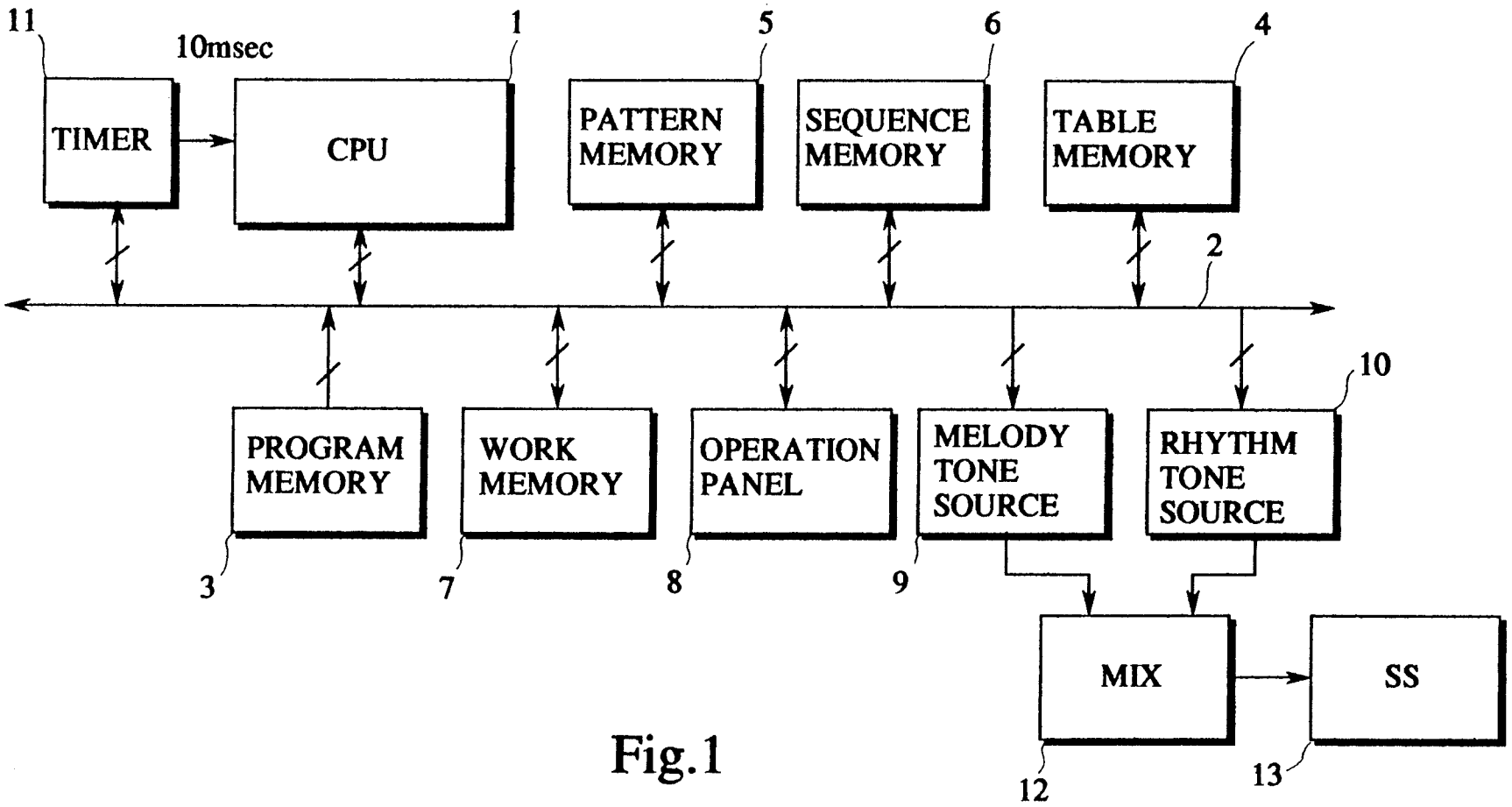
FIG. 1 is a block diagram of a sequencer embodying the present invention.

A sequencer embodying the present invention is disclosed by referring to the drawings.

The sequencer is provided with a playing data storage area consisting of five tracks TR=0 to 4 (song tracks), four tracks of TR=0 to 3 being sequence tracks for melody data, or the like, and the track of TR=4 being a backing track in which pattern designation data is stored. The pattern designation data is data which designates a pattern. Each of the patterns consists of three parts of a chord part, a base part and a rhythm part which is stored in a pattern storage area (i.e. TR=4), respectively. Each of the patterns is specified with a pattern number.

The sequencer is capable of transferring the designated pattern data to a sequence track (i.e. TR=0 to 3). The transfer mode has two modes, a put parts mode and an expand parts mode. The put parts mode is a mode in which when a pattern number and start timing are designated by a player, the pattern is read from the pattern track, and then the read pattern with the designated start timing is written into a sequence track. The expand parts mode is a mode in which backing data edited in the backing track, and pattern designated data, is translated into playing data and written into a sequence track. Translated part is only one part out of three parts, the chord part, the base part and the rhythm part.

FIG. 1 illustrates a block diagram of the sequencer. The sequencer is controlled by a CPU 1. The CPU 1 is connected, through a bus 2, to a program memory 3, a table memory 4, a pattern memory 5, a sequence memory 6, a work memory 7, an operation panel 8, a melody tone source 9, a rhythm tone source 10, and a timer 11. The timer 11 is connected to the CPU 1 to output an interrupt trigger every 10 ms. The melody tone source 9 and the rhythm tone source 10 are connected to a sound system 13 through a mixer 12. The mixer 12 is a circuit to mix a musical tone signal outputted from the rhythm tone source 10 at a specified rate. The sound system 13 is a circuit to amplify a inputted musical tone signal and then output it from a speaker. The program memo 3 is configured with a ROM which stores a program shown in the flow charts of FIGS. 8 to 16 of the drawings. The table memory 4 is configured with a ROM which stores a table shown in FIG. 7. The pattern memory 5 is a memory which stores the above-mentioned accompaniment patterns. The sequence memory 6 is a memory which consists of five tracks including the above-mentioned sequence tracks of TR=0 to 3 and the above-mentioned backing track of TR=4. The pattern memory 5 and the sequence memory 6 are RAMs backed up by a battery. The work memory 7 has registers to temporarily store various data generated during inputting process of playing data and playing back process of the playing data. The work memory 7 also configured with a RAM. The melody tone source 9 and the rhythm tone source 10 are circuits to generate musical tone signals based on the playing data read from the sequence memory 6.

Figure 2:
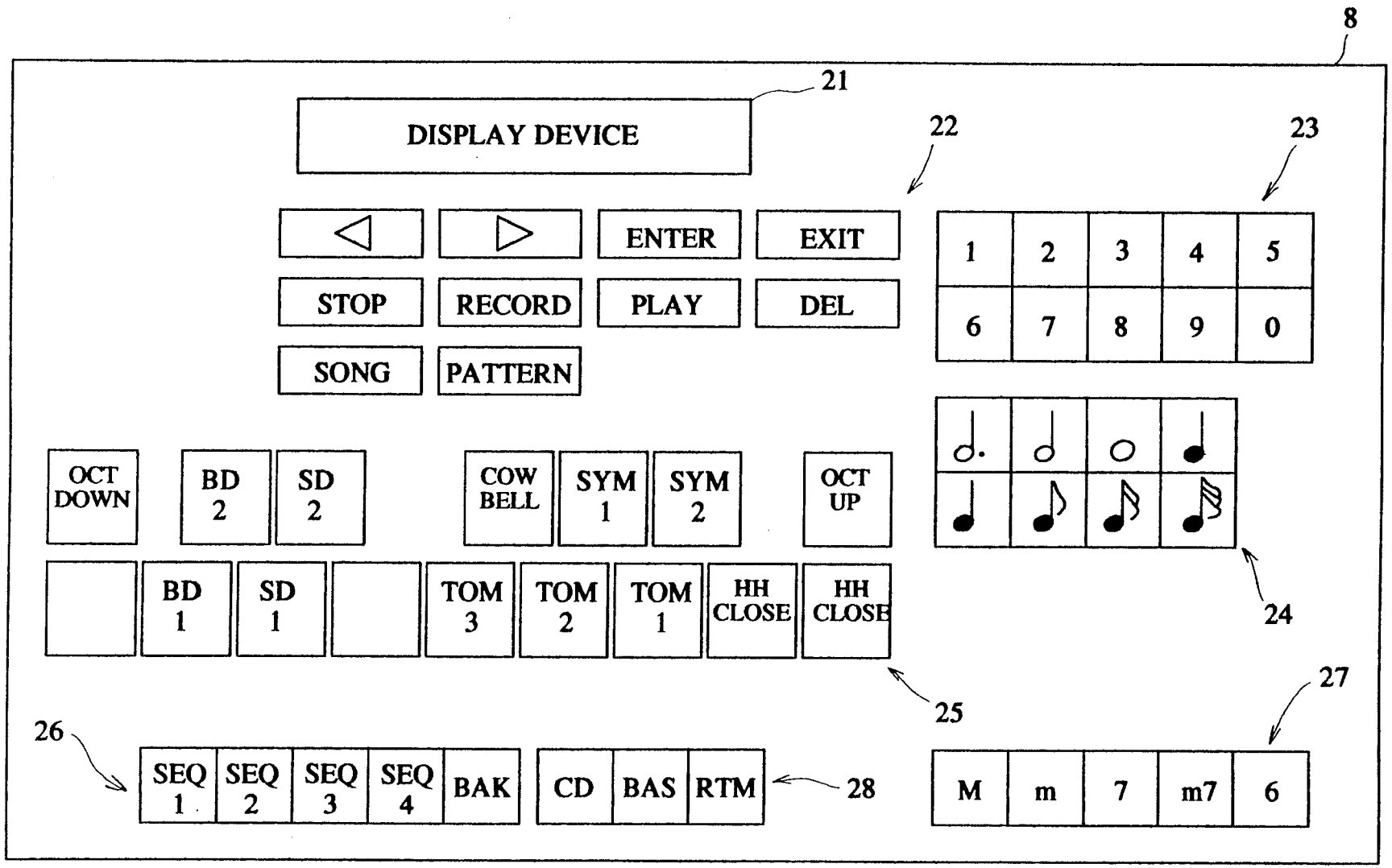
FIG. 2 shows an operation panel of the sequencer.

FIG. 2 is a schematic view of the above-mentioned operation panel 8. The operation panel 8 is provided with a mode key 22 for switching various modes of the sequencer, a ten digit key 23 for inputting numeric values, a note key 24 for inputting note length at the time of inputting playing data, multi-function key 25 for designating a rhythm instrument at the time of inputting rhythm pattern, a track selection key 26 for selecting a track to record or play back, a chord key 27 for inputting a chord, and a part designation key 28 for designating a part of the pattern track or the backing track. The operation panel 8 has an LED matrix display device 21. The display data of the display device 21 is changed depending on the various modes (see FIG. 3), including numeric values inputted from various keys.

FIGS. 3(A), (B) show mode configuration of the sequencer and examples of display data of the display device 21.

Figure 4:
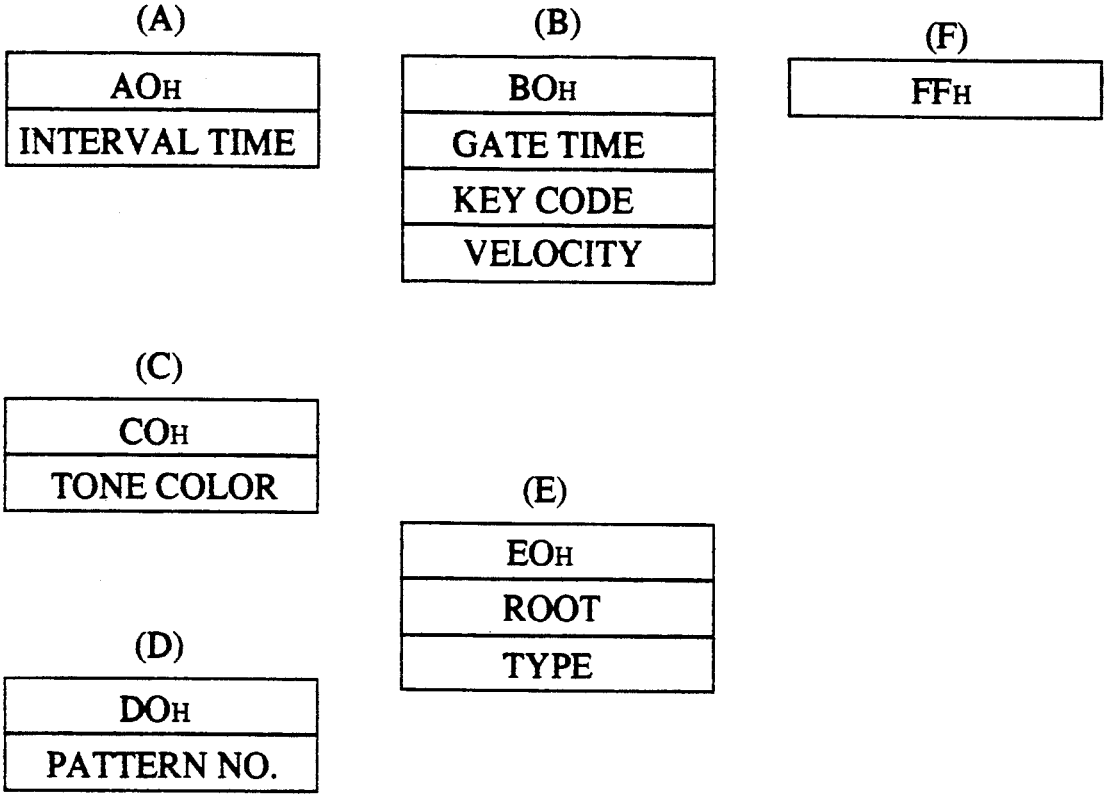
FIG. 4 shows a format of written data in a memory of the sequencer.

The modes of the sequencer are mainly divided into two modes, a song mode of MOD=0 and a pattern mode of MOD=10. The mode switching can be done by a SONG key and a PATTERN key. The song mode allows a song record mode of MOD=1 for inputting playing data, a put parts mode of MOD=2, and an expand mode of MOD=3 to enter therefrom. The song record mode allows a song step record mode of MOD=5 and a tone color record mode of MOD=6 to enter therefrom when the written track is a specified track. The song step record mode of MOD=5 is a mode to write data, such as melody data and pattern designation data, into a sequence track. FIG. 4 shows a data format to write. The tone color record mode is a mode for designating a tone color number. The put parts mode of MOD=2 is a mode for transferring playing data stored in the pattern memory 5 to a sequence track as playing data. A chord is designated in the transferring process, and then the tone pitch of the transferred data is shifted up based on the chord. The expand parts mode of MOD=3 is a mode in which the backing data stored in the backing track of TR=4, being pattern designation data consists of pattern numbers and chords, is translated into normal playing data and written into a sequence track. The put parts mode and the expand parts mode enables playing data recorded on the sequence track to be edited along with the ordinary playing data. Any mode of the above-mentioned modes can be entered into the play mode of MODE=4 with key-on of the PLAY key. The play mode is a mode which performs automatic playing playing data designated with a song number. The stop key returns the play mode to a previous mode.

The pattern mode of MOD=10 is a mode in which a pattern is stored into the pattern memory 4. This mode can be entered into the pattern record mode of MOD=11 and the part step record mode of MODE=12. In the pattern record mode, a pattern number for identifying a pattern are various data, such as the number of bars of the pattern, are written. In the part record mode, pattern data is inputted with use of the note key 24 or the like.

The display device 21 displays the following data in the above-mentioned modes:

In the song mode, a bar's number, a tempo, time, and a song number from the left side of the display device 21 are displayed. The underline of the drawings represents places in which a cursor can be moved freely by use of the cursor keys. The ten key 23 can input any numeric value on the cursor point specified by the cursor key. In the song mode, a performer can edit the bar's number, the tempo, the time, and the song number displayed on the display device 21.

In the song record mode, a bar's number, a tempo, time, and a track number are displayed on the display device 21. The ten key 23 can input the bar's number, the tempo and the time, and the track selection key 26 can input the track number.

In the song step record mode, the display device 11 displays a bar's number, a beat, the number of clocks, note length, a tone pitch, gate time and a key velocity. This mode is a mode to input note data with a step way. Tone generation timing of the note is designated with the bar's number, the beat, and the number of clocks, and tone generation length is designated with the note length and the gate time. The note length is designated with the note key 24. The gate time causes a rate of tone generation length of the note length. The tone pitch can be designated with the multi-function key 25. That is, the multi-function key 25 is formed with one octave keyboard, and therefore, any tone pitch in a basic octave can be designated with use of the keyboard. An octave-up key and an octave-down key are provided at the both sides of the multi-function key 25, designating an octave-up tone pitch or an octave-down tone pitch of the same tone name as a tone name in the basic octave. The key velocity is inputted from the ten key 23.

In the tone color record mode, a bar's number, a beat the number of clocks, and a tone color number to start playing at the timing calculated with them are displayed on the display device 21.

The put parts mode is a mode in which one part data of any pattern is changed with the chord and transferred to any sequence track, the pattern number to be transferred, the part and the root and type of the chord are displayed on the display device 21, and track number to be transferred and the bar number are also displayed. The cursor allows the pattern number, the track number and the bar number to be inputted by use of the ten key. The part and the root and the type of the chord can be inputted with use of the part selection key 28 the multi-function key 25 and the chord designation key 27, respectively.

The expand part mode is a mode in which one part of the backing data written in the backing track is translated into playing data and then transferred to any sequence track, so that the part to be transferred and the destination track are displayed.

The pattern record mode is a mode to write a pattern into the pattern memory. The display device displays a pattern number, time, a part name and the number of bars in the pattern. The part name is represented with such symbols as printed on the part selection key 26, for example, the code track with CD, the base track with BAS, and the rhythm track with RTM.

As in the part step record mode accompaniment data is inputted with the step way, the display data is the same as the song step record mode.

FIG. 4 shows a format of playing data stored in the pattern memory 5 and the the sequence memory 6. FIGS. 6(A) to 6(F) show formats of time interval data, note data, tone color designation data, pattern designation data, chord designation data, and end data (end code), respectively. The data can be identified with the header data consisting of a one byte code as AOH, BOH, COH, DOH, EOH, and FFH.

The AOH code is followed by time data interval.

Similarly:

BOH: is followed by gate time, key code and velocity data

COH: is followed by tone color number data

DOH: is followed by pattern number

EOH: is followed by root and type of chord data where the time interval (data) is data which represents a time length with the number of clocks from the immediate preceding event to the present event.

Figures 5, 6:
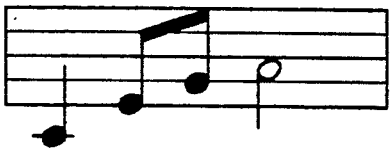
FIG. 5 represents a recording method to a sequence track.
FIG. 6 represents a recording method to a backing track.

FIG. 5 shows an example of sequence data and a corresponding score to the data. FIG. 6 shows an example of pattern designation data in the backing track and a schematic corresponding score to the data.

FIG. 7 shows a tone pitch shift table stored in the table memory 4. This table is formed on the basis of a minor chord. With the use of the table, in the case of writing of a minor chord, a major third tone in the table is shifted down by a semi tone so as to become minor third tone, in the case of writing a triad, i.e.,a chord not including sixth tone or seventh tone, a minor seventh tone in the table is shifted up by a tone so as to become a octave tone, and in the case of writing a chord including sixth tone, a minor seventh tone in the table is shifted down by a semi tone so as to become a major sixth tone. Any other tones doesn't shifted up and down.

FIGS. 8 to 16 are flow charts showing the operational steps of the sequencer.

Figure 8:
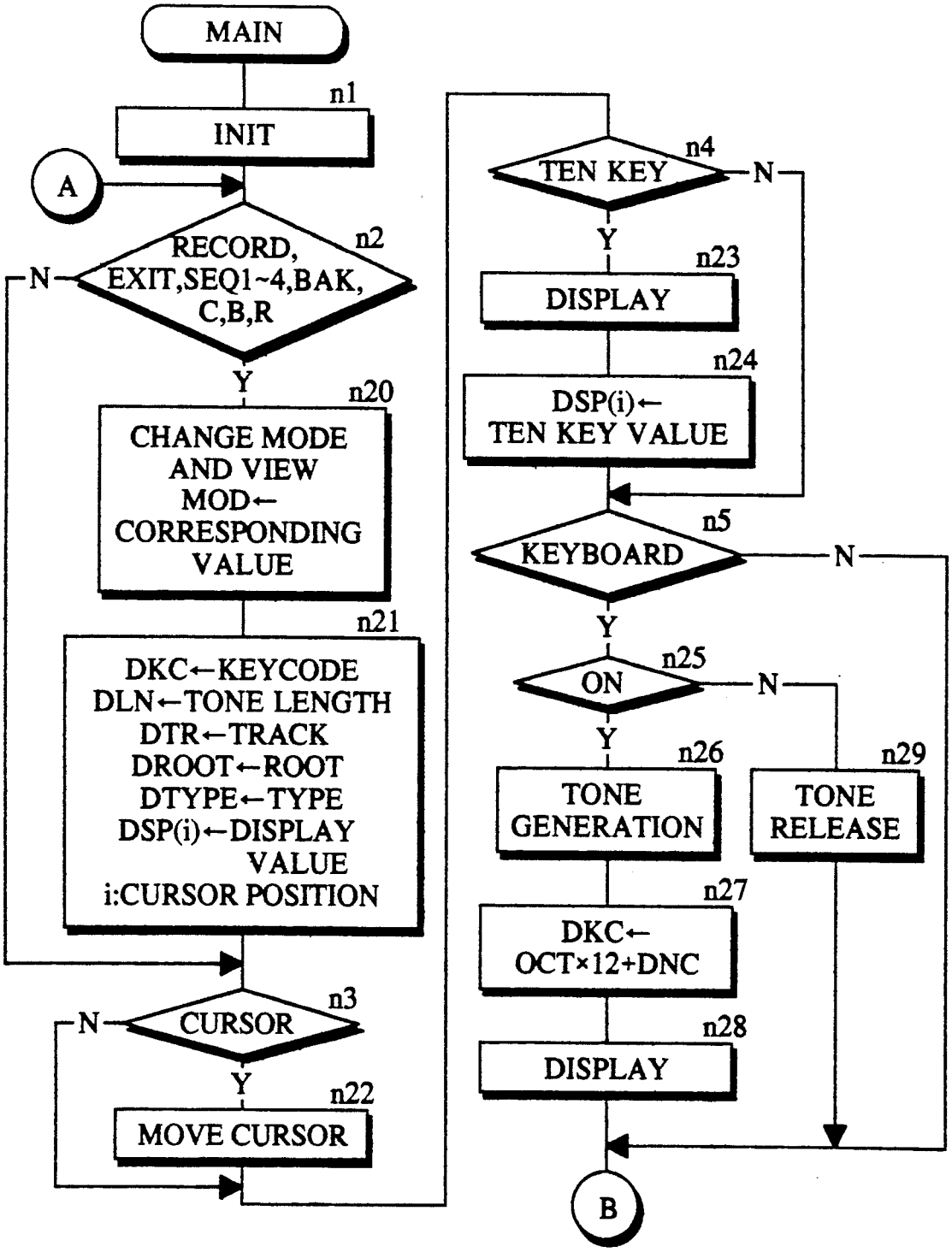
FIGS. 8 to 16 are flow charts showing the operational steps of the sequencer.
Figure 8:
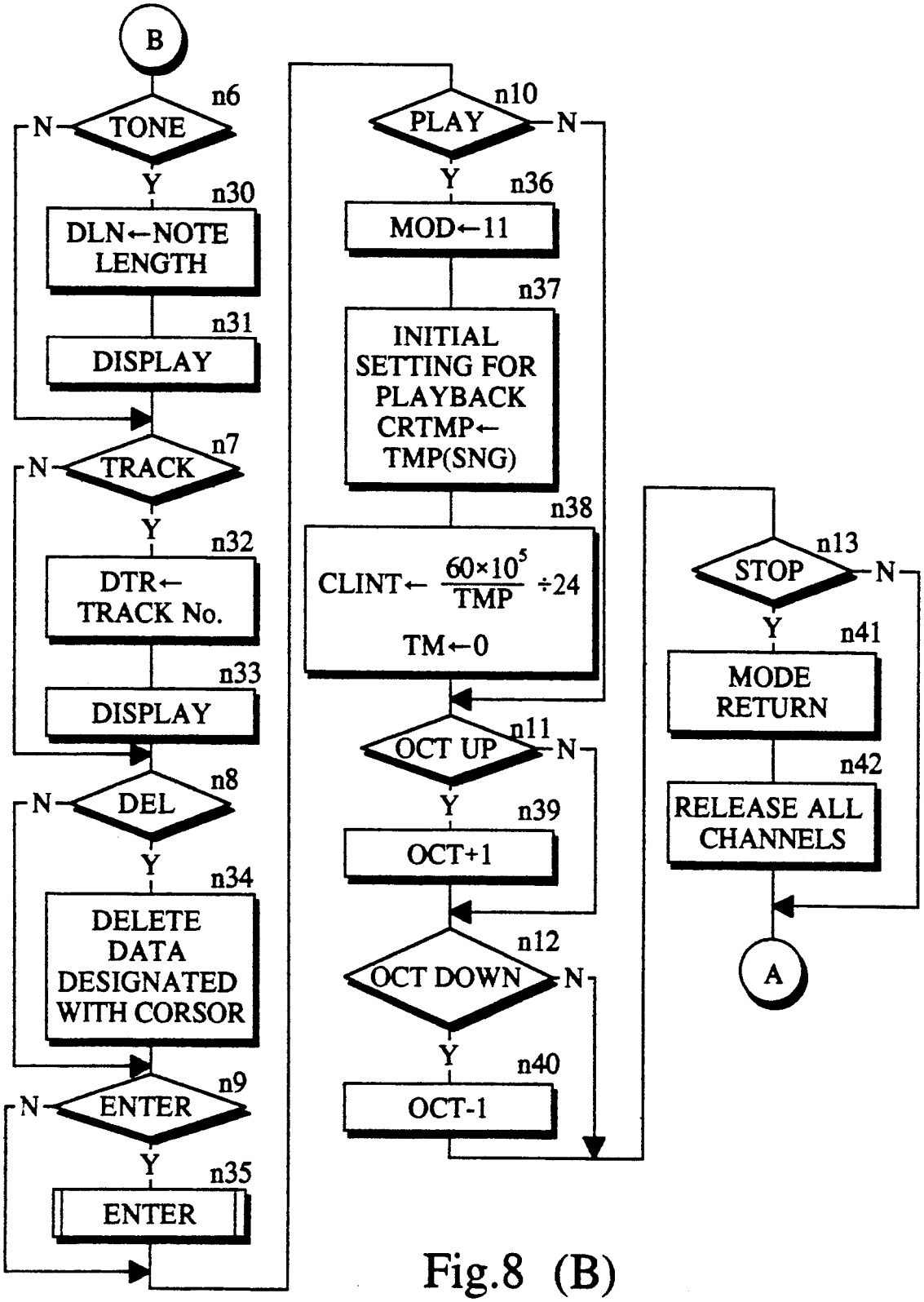

FIG. 8 is a flow chart of a main routine. When a power is turned on, an initial process is performed to registers and so on (n1) to substantially start the process for the sequencer. Next, whether any on-event or off-event of the operation panel 7 occurs is judged (n2 to n13). If any event occurs, a process corresponding thereto is performed (n2O to n42).

Figure 3:
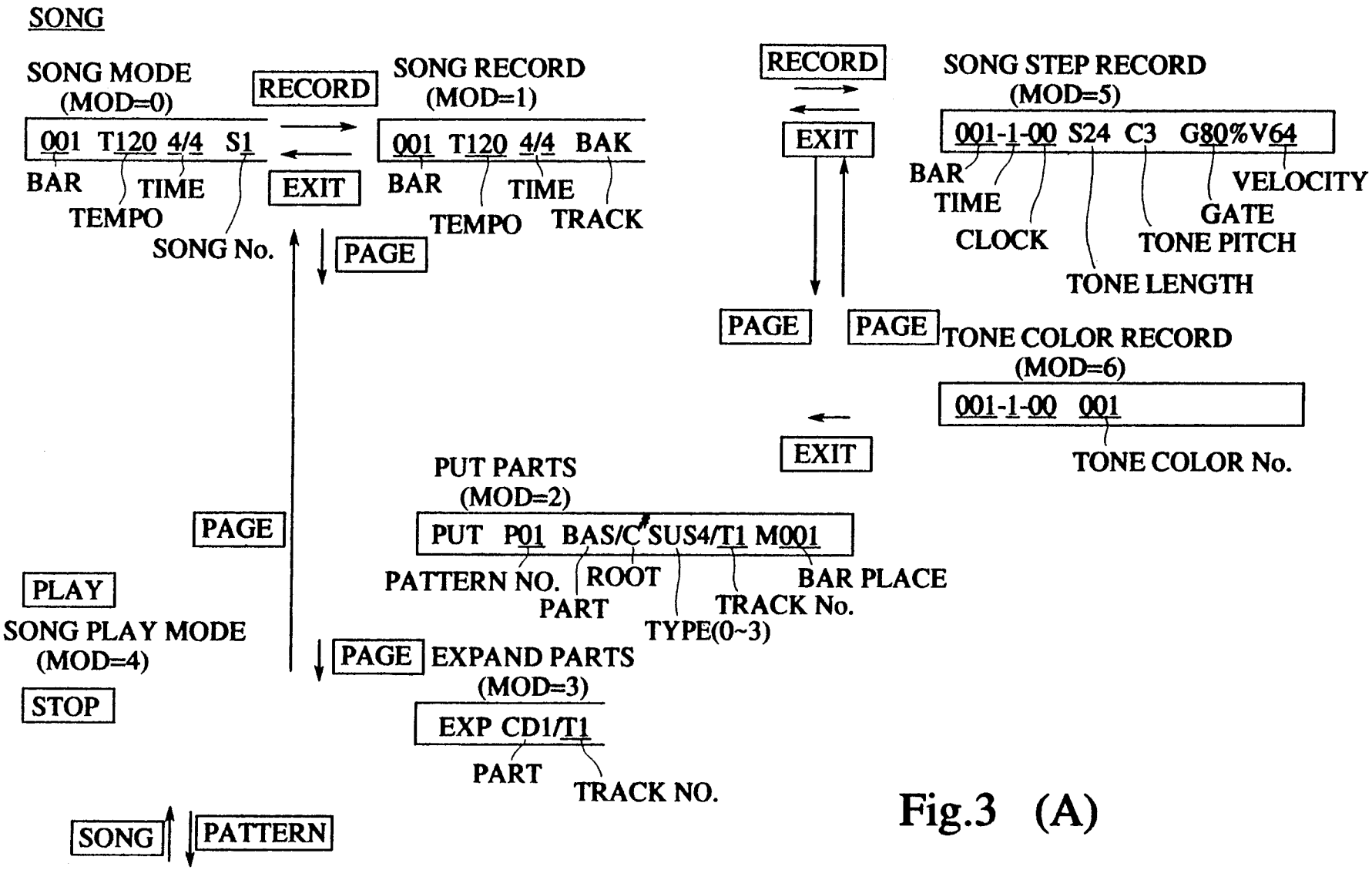
FIGS. 3(A), (B) show mode configurations of the sequencer and examples of display data of the display device.
Figure 3:
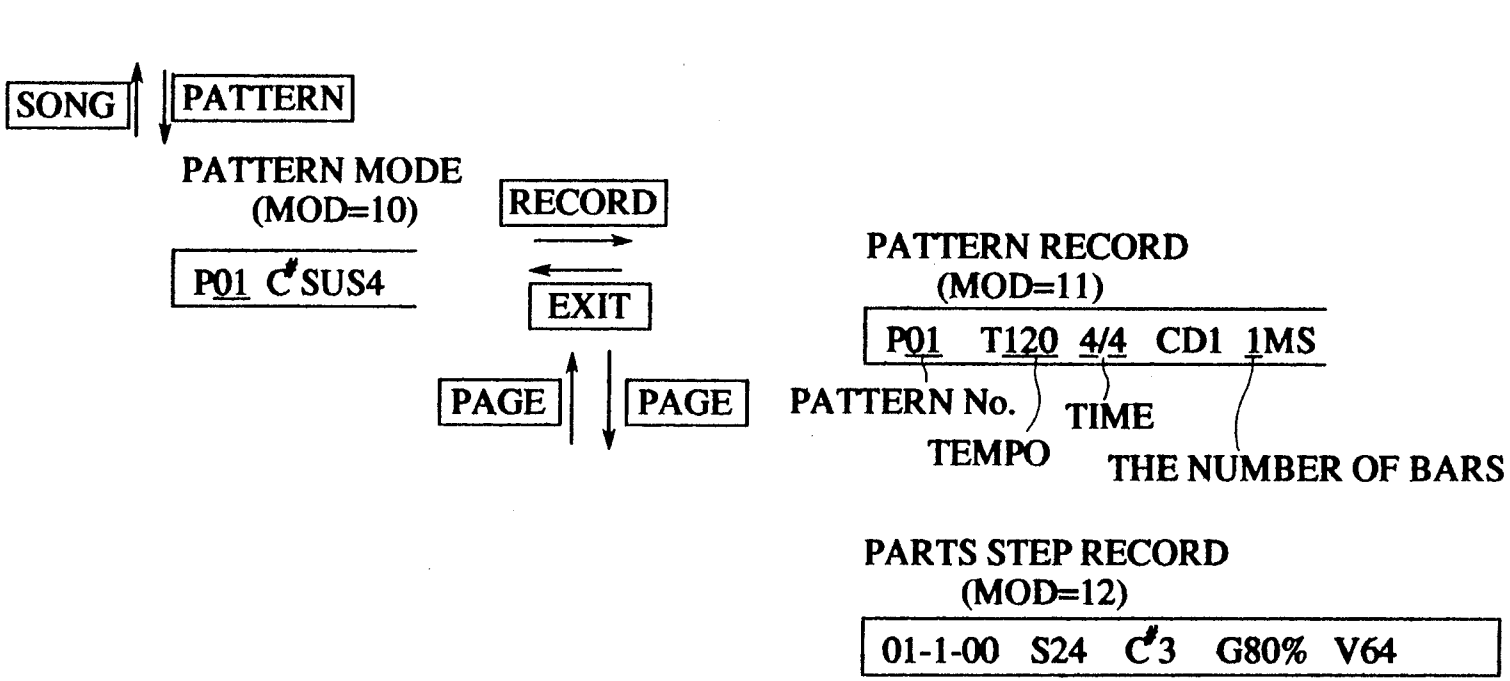

If the RECORD key, the EXIT key or the track selection key is depressed, a mode change is done according to the mode configurations of FIG. 3. That is, the display data is changed according to FIG. 3, and then a corresponding value is set into the mode register MOD (n2O). Further, corresponding values are set into the various registers, DKC, DLN, DTR, DROOT, DRYPE, and DSP(i) (n21). When the cursor key is moved, the cursor is moved according to the cursor designation point (n22). when the ten key is operated, the inputted numeric value is displayed on the present cursor point (n22), and the value is stored into the corresponding register DSP(i) to the cursor point (n24). When the multi-function key 14 is operated as a keyboard for designating a tone pitch, the tone generation process is performed (n26), and then a tone pitch is calculated by adding the value of the octave register OCT to the tone pitch designated by the key 14 to store it into the display-tone-pitch register DKC (n27). When the off-event of the keyboard occurs, the release tone process is executed (n29). When the note key is depressed, the note length designated by the note key is stored into the display-note-length register DLN (n3O), the data being displayed on the display device (n31). When the track selection key is depressed, the track number designated by the key track system key is stored into the display-track-number register DTR (n32), the data being displayed on the display device (n33). When the DEL key is depressed, the data designated at the present time is cleared (n34). when the ENTER key is depressed, the corresponding process to the present status is performed (n35). When the PLAY key is depressed, the value of "4" is set into the MOD register (n36), and then, the initial setting process for playback is performed (n37). The initial setting process for playback is a process in which each pointer of tracks to be played back is addressed to the head address. After that, the clock interval CLINT is calculated, and the timer register TM is cleared (n38). when the octave-up key or the octave-down key is depressed, the octave register OCT is incremented or decremented (n39, n4O). when the stop key is depressed, the process returns to a immediate preceding mode, the display data is changed and the corresponding value to the display data is set into the MOD register (n41). Next, if any channel on tone generation status exists, release data is sent to the channel (n42).

Figure 9:
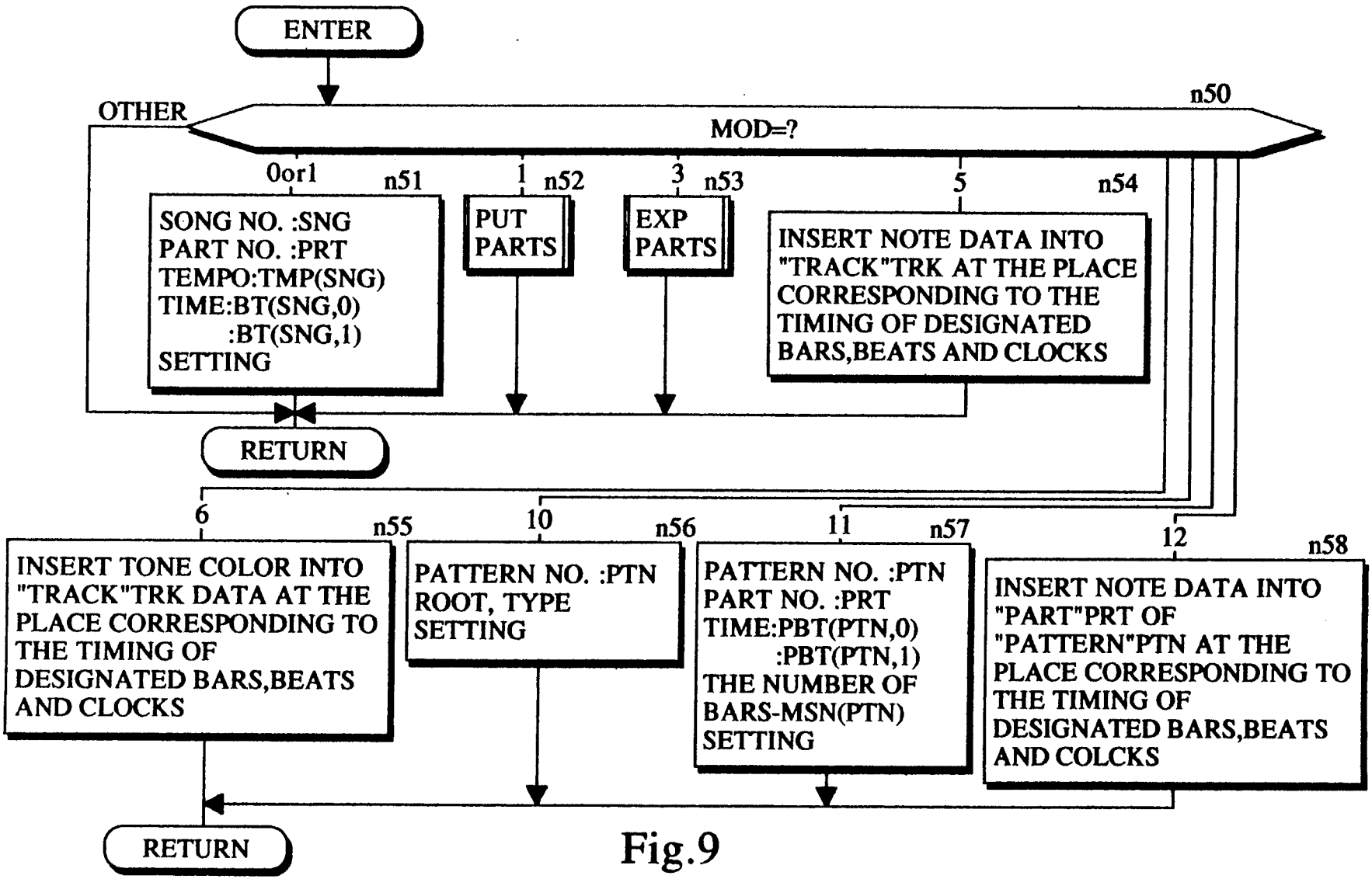

FIG. 9 is a flow chart showing the ENTER key process. If the ENTER key is depressed, the display data displayed on the display device 11 at the present time is fetched into the registers according to the present mode (n5O). If the present mode is the song mode (MOD=0) or the song record mode (MOD=1), the displayed values on the cursor are fetched into the registers, the song number register SNG, the bar's number register BAR, the tempo data register TMP(SNG), and the time data register BT(SNG,0), BT(SNG,1) (n51). if the present mode is the put parts mode (MOD=2) or the expand parts mode (MOD=3), a corresponding subroutine, i.e, a put parts process and a expand parts process, is perfomed, respectively (n52, n53). If the present mode is the song step record mode (MOD=5), the tone color record mode (MOD=6), the pattern mode (MOD=10), the pattern record mode (MOD=11) or the pattern step record mode (MOD=12), the display data is fetched into the registers, and then the data is inserted into the specified address of the pattern memory 5 or the sequence memory 6 (n54 to n58).

Figure 10:
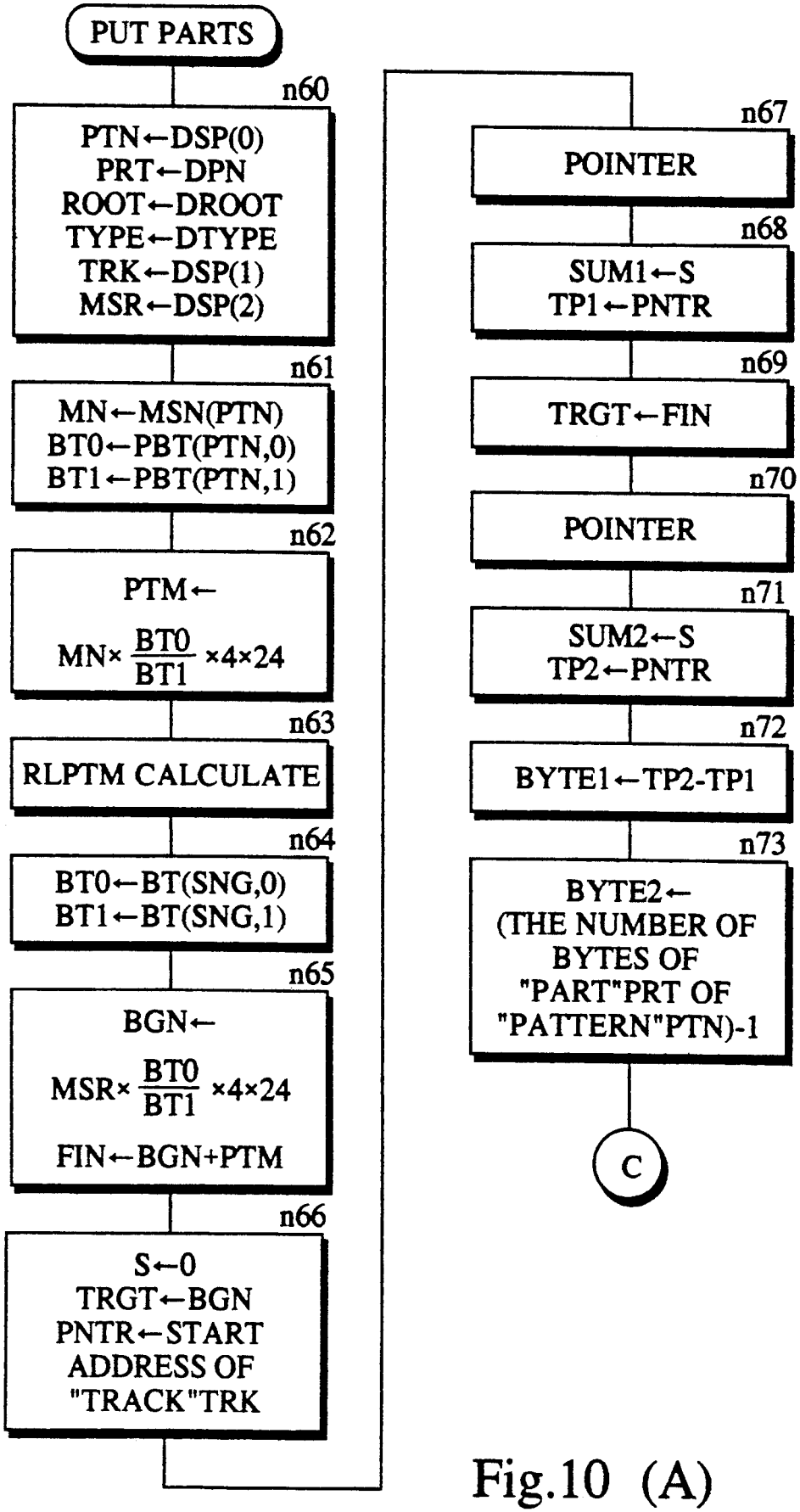
Figure 10:
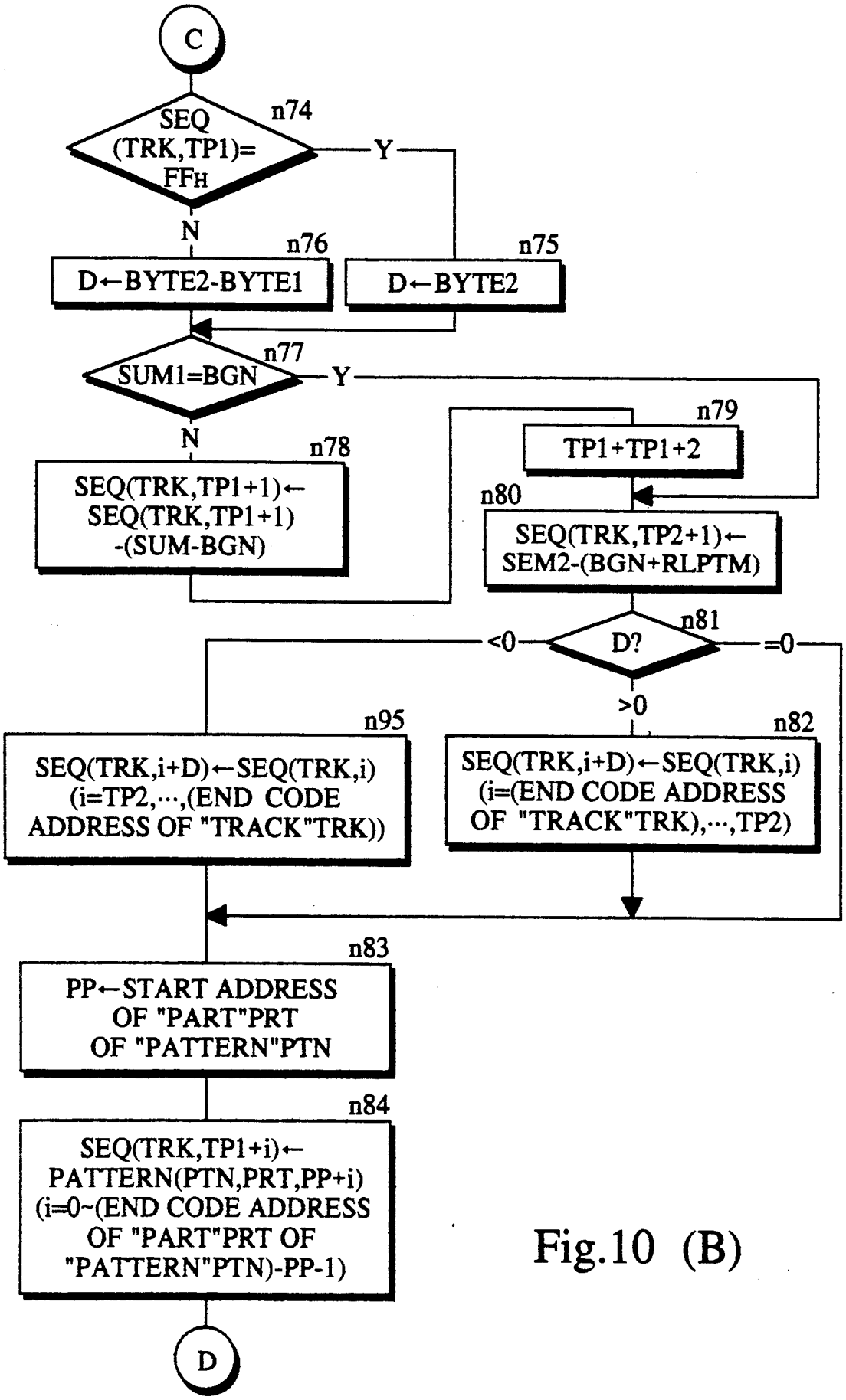
Figure 10:
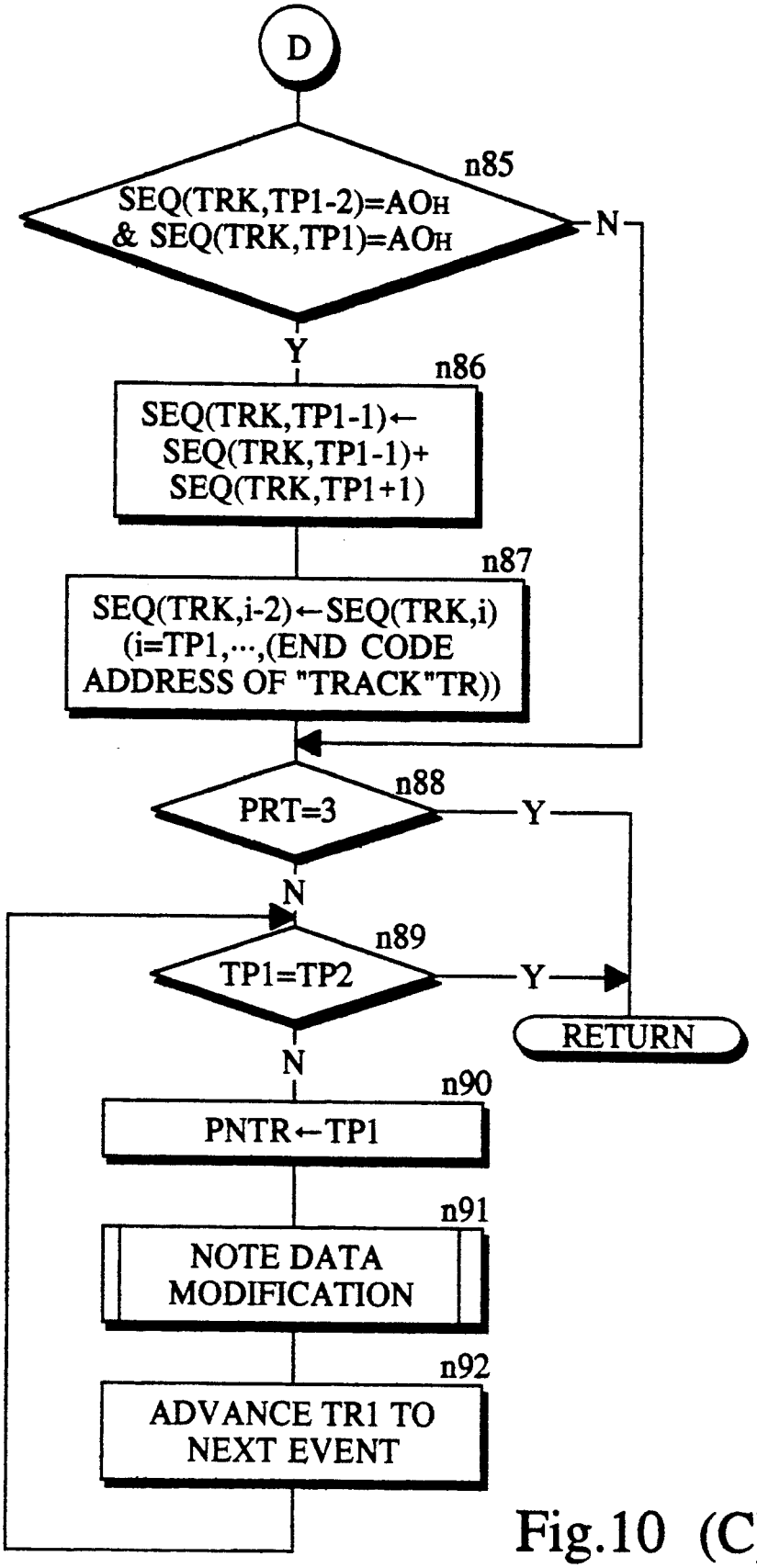

FIG. 10 is a flow chart of the put parts process. This process is a process in which pattern data is inserted into the designated track. If the preceding written data exists in the designated track, the data in the designated phrases of the track is replaced with the new data by data insertion.

First, the display data on the display device 21 is fetched into the registers (n60), the number of the bars and time data is read from the designated pattern (n61). The pattern length to be inserted, i.e. the number of clocks, is calculated based on the read data (n62). Then, time interval data between the beginning note data and the ending note data of the designated pattern is summed and the sum is changed to the number of clocks to set into the register RLPTM (n63). The insertion area of the pattern is deduced with the number of clocks from the beginning address of the track to be inserted (n64 n65), and the note data immediately preceding to the insertion area (TP1) and the note data immediately following to the insertion area (TP2) is searched (n66 to n71). At step n72, the number of bytes to be deleted from the designated track is calculated to store it into the register BYTE1 by subtraction between the TP1 and the TP2. The number of bytes of the pattern to be inserted is stored into the register BYTE2. To delete the end code of "FFH" from the pattern, "1" is subtracted from the number of all bytes. Next, subtraction between the BYTE2 to be insert and the BYTE1 to be delete is executed and the result is set into the register D (n76). However, if the insertion point is the end point of the track data, i.e., the pattern data is appended into the track, the BYTE2 is transferred to the D (n74, n75). Next, whether the beginning point of the pattern (representing with the number of clocks) is the same as one of the deleted sequence data is judged (n77). If they are different, the interval data of note data immediately preceding the pattern insertion area is modified to one from the note data to the beginning note data to be inserted (n78 to n79). Similarly, the modified process is done to the time interval data immediately following the pattern insertion area (n80). Next, the insertion area is ensured in the designated track based on the register D (n81, n82, n95). That is, if $D>0$, the area of the sum of D bytes and the bytes of the deleted data is ensured (n82), otherwise if $D<0$, the area of the sum of $-D$ bytes and the bytes of the deleted data is ensured (n95). If $D=0$, the sequence track is not shifted (n81).

After that, the pattern data is copied into the designated sequence track (n83, n84). If the beginning data of the pattern is time interval data, the data immediately preceding the pattern insertion area is modified by adding the time interval data of the beginning data to the preceding time interval data (n85 to n87). If the copy process is not directed to the rhythm part, note data is modified based on the chord (n88 to n92).

Figure 11:
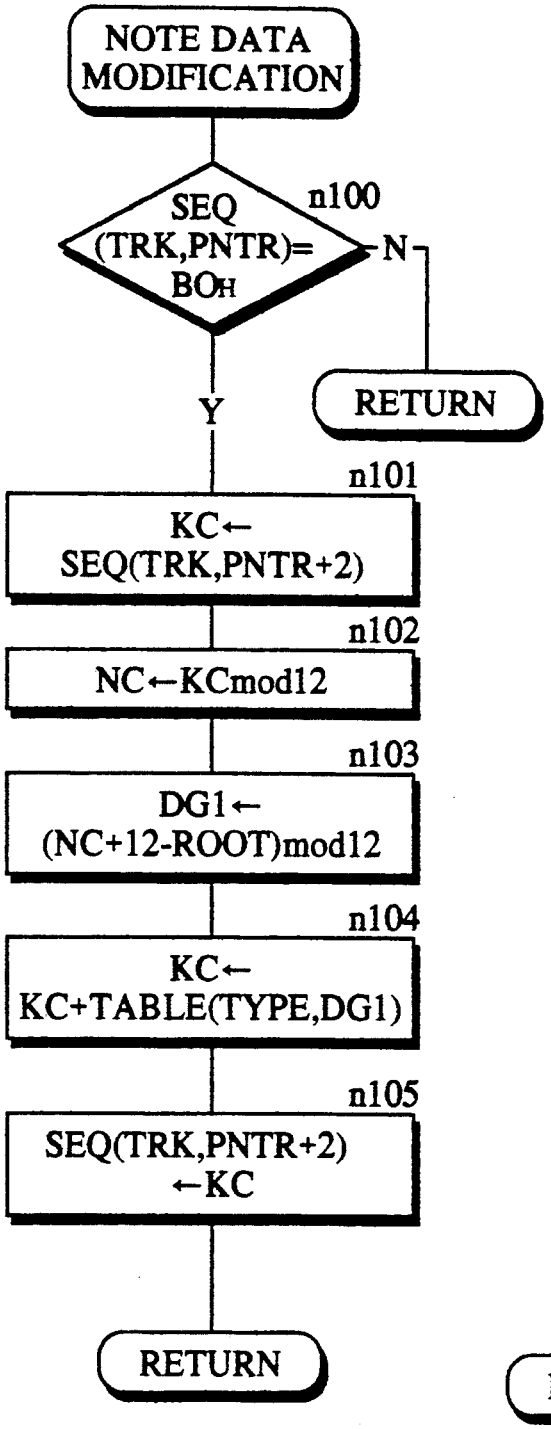

FIG. 11 is a flow chart showing the note data modification process. This process is a process to modify the tone pitch data in the note data based on the chord. Therefore, if read data is data other than the note data, the process returns with no operation (moo). With the note data, the key code is read (n101), and what degree this note data stands at to the root of the chord is found (n102, n103). The table is searched based on the result, the read value being added to the note data (n104), and then, the modified data is replaced with the old data (n105).

Figure 12:
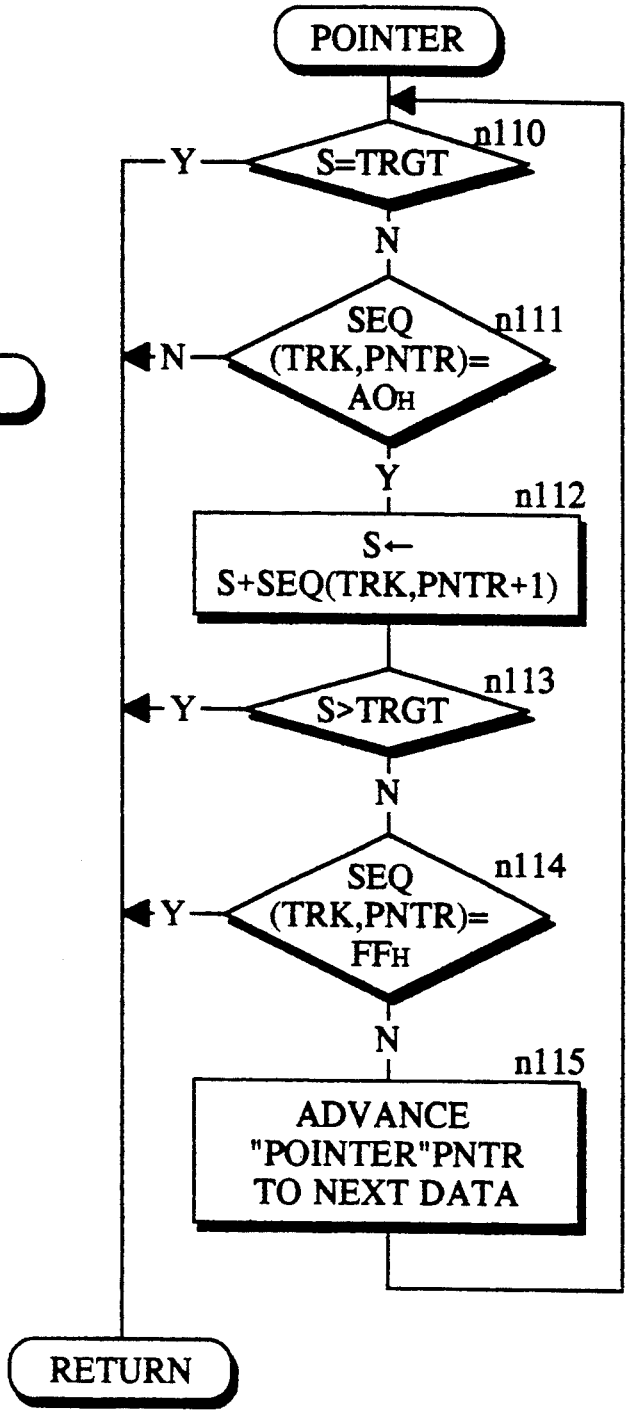

FIG. 12 is a flow chart showing the pointer process. This pointer process is a process in which the time interval data including (representing with the identifying data of "AOH") the designated clock timing is searched, and the pointer PNTR is addressed to the beginning of the time interval data. The time interval values read from the designated sequence track are accumulated in the S register (n111, n112), and then if the contents of the S register equal to or more than the target value TRGT (see step n69, n65), the process returns (n110, n113). If the read data equal to the end code the process returns with no operation (n114). In the case of S=TRGT, the pointer PNTR is moved from the beginning of next data to the interval data (n115).

Figure 13:
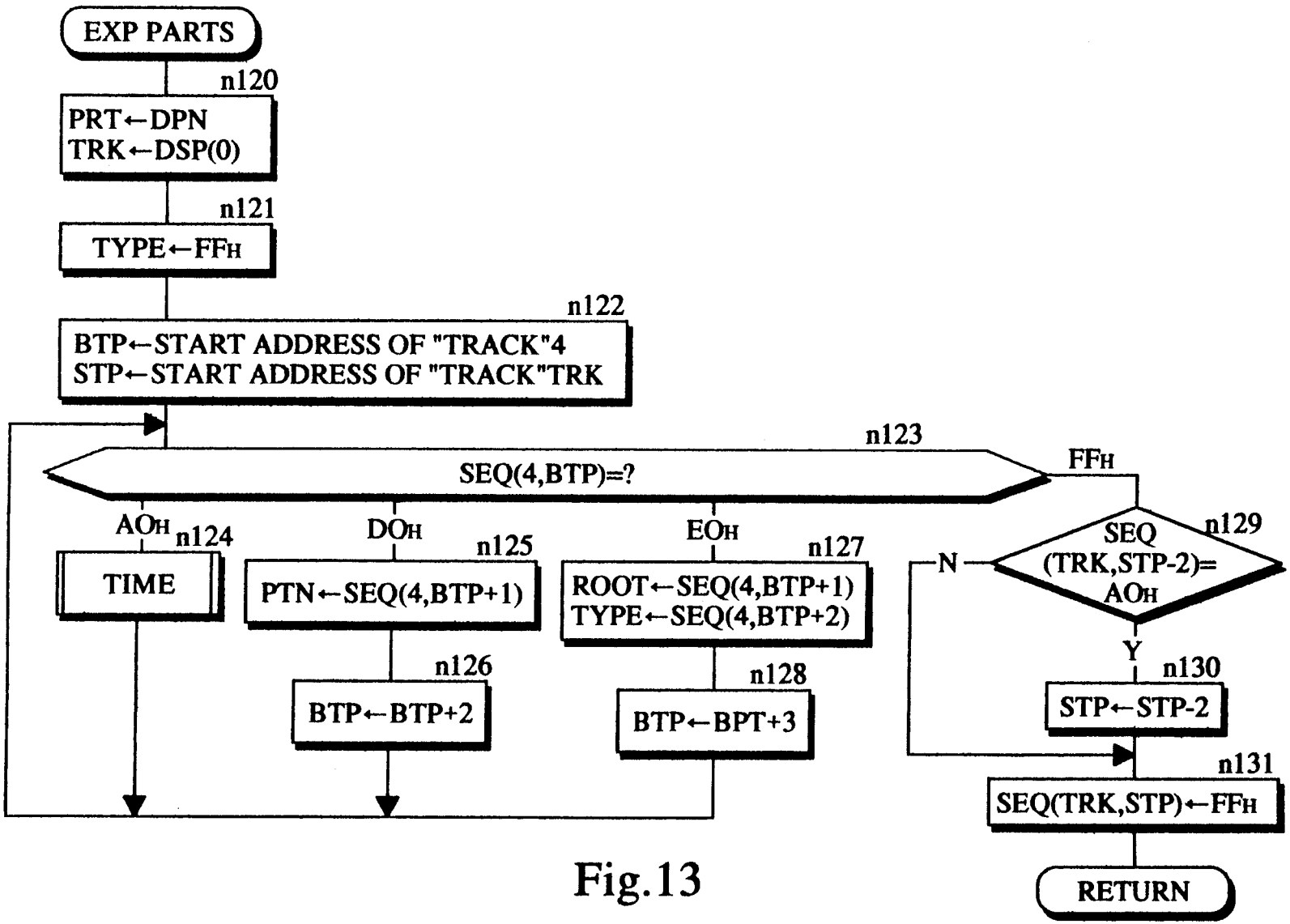

FIG. 13 is a flow chart showing the expand parts process. In this process, the accompaniment data (being represented with pattern designation data) stored in the backing track is translated into playing data , and the data thus translated is transferred to the sequence track. From the backing track, the part to be copied is set into the PRT register, and the track number for the transfer is set into the TRK register (n120). The value of "FFH" is set into the chord type register, the beginning address of the backing track and the designated sequence track being set into the BTP register and the STP register (n121, n122). After the above-mentioned set-up process, data of the backing track is read successively (n123). With the time interval data in reading, the time subroutine is performed (n124) to keep reading data. With the pattern designation data in reading, the read pattern is set into the PTN register (n125), and then next reading process is performed (n126, n123). With the chord designation data in reading, the root data of the chord is set into the root register, the type data of the chord is set into the TYPE register (n127). After that, the pointer is moved to read next data (n128, n123). With the end code of "FFH" in reading, the end code is written into the sequence track (n131), the process returns. In this case, if the end data of the sequence track is time interval data, this data is deleted because this data is not needed (n129, n13O). After that end code data is written (n131).

Figure 14:
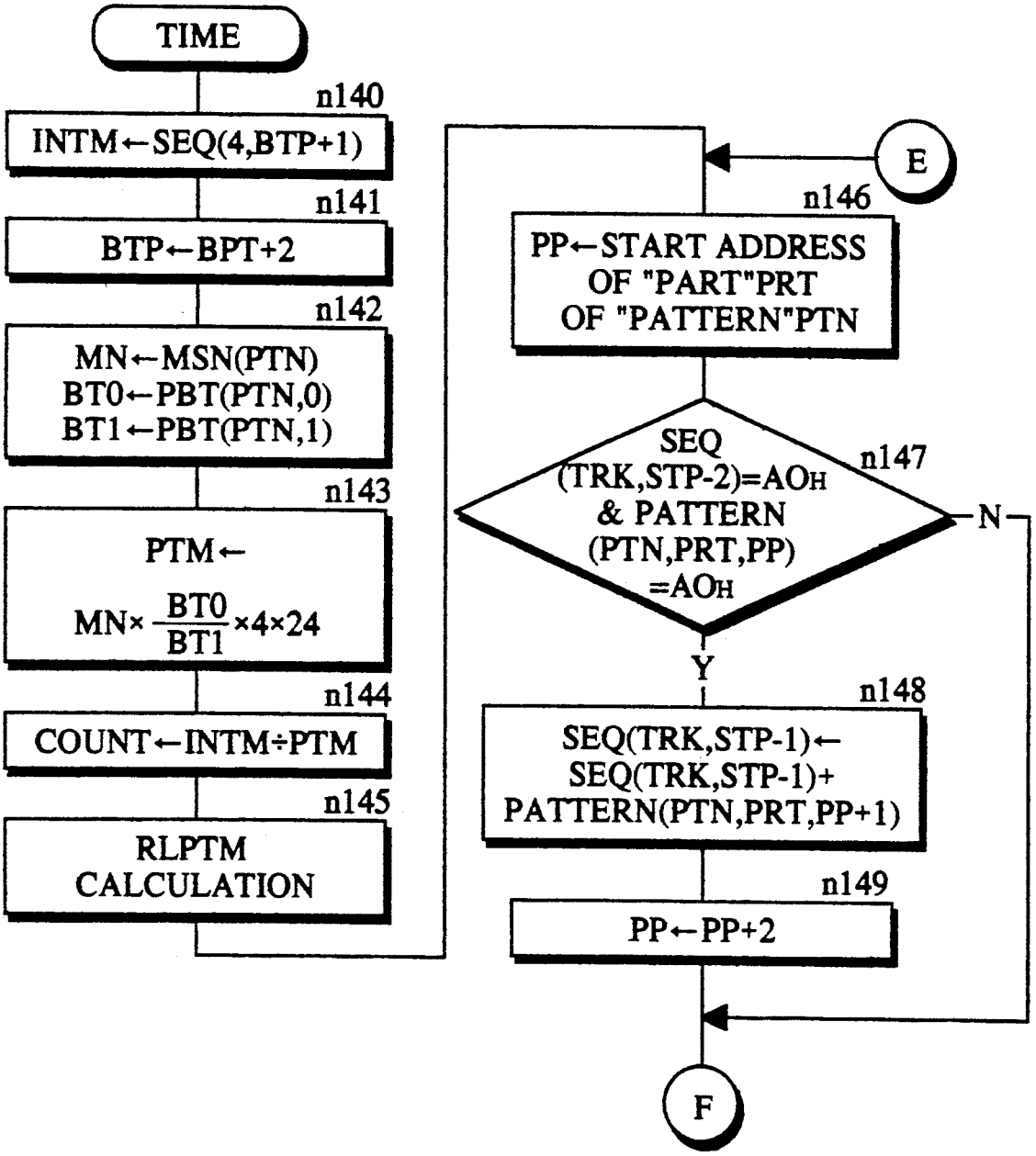
Figure 14:
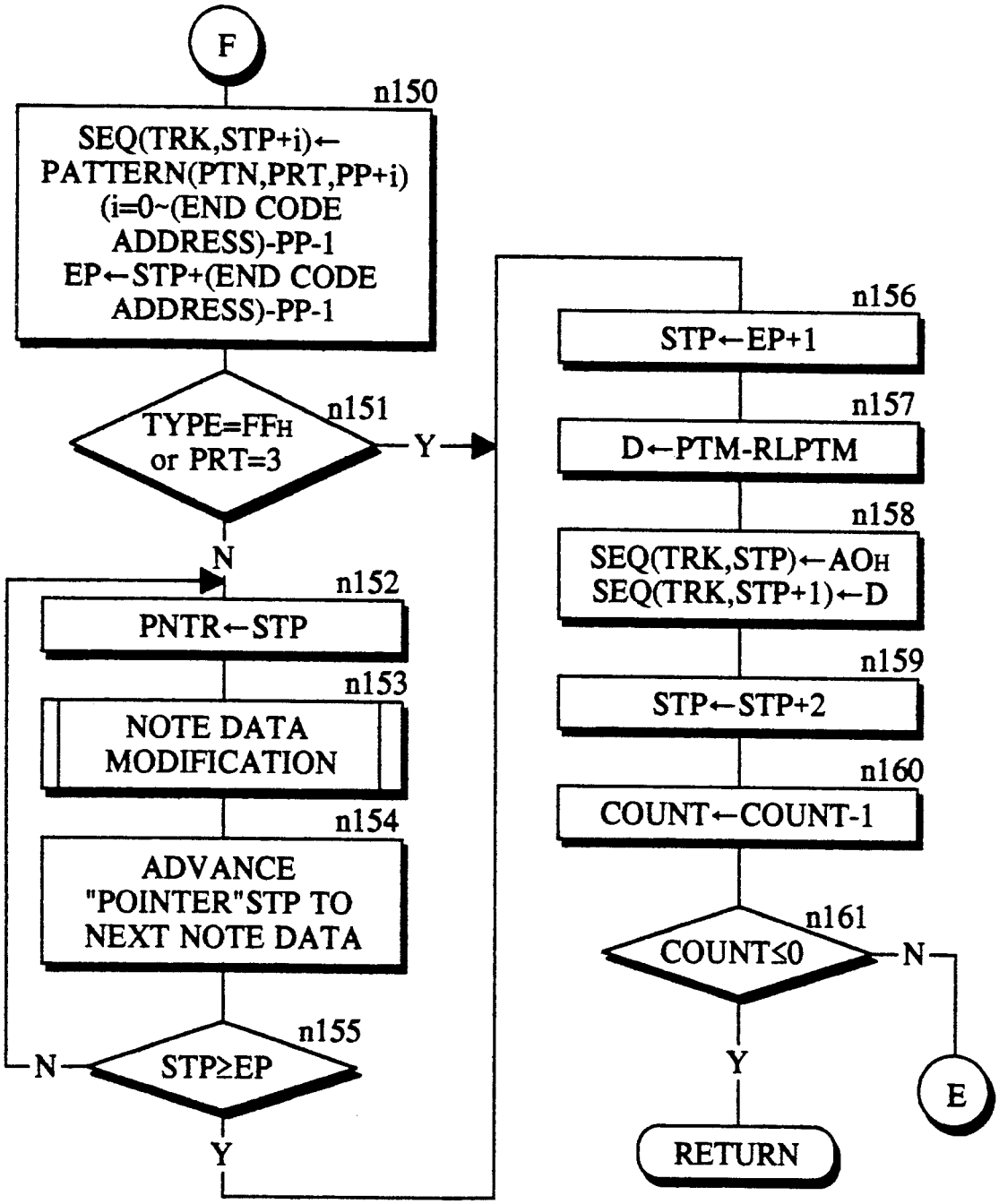

FIG. 14 is a flow chart showing the time process. In this process, data of the designated part in the pattern read from the backing track is copied repeatedly into the sequence track. First, the specified time interval data which represents automatic playing period is read from the backing track (n140), the pointer of the backing track being advanced (n141), the number of the bar, time, etc. of the pattern being read (n142). Next, the repeat number COUNT is calculated (n143, n144). Then, the sum of the time interval data from the beginning to the ending of the pattern is translated into the number of clocks, the number thus translated being set into the register RLPTM (n145). After that, the pattern data is read from the pattern track, being copied into the sequence track (n146 to n150). With this copy, if the last data of the sequence track immediately preceding the insertion area is time interval data the data to be first copied is also interval data, the data are joined (n147 to n149). After the copy, the copied note data is modified based on the designated chord data (n151 to n155), i.e., the key code is modified based on the type TYPE of the chord and the degree DG from the root ROOT to the note data. Next, the time differences between the tone generation timing of the last copied note data and the end timing of the pattern is stored as the time interval data (n156 to n159). The process from step n146 to n159 is repeatedly performed till the COUNT equals "0", the process returns (n160, n161).

Figure 15:
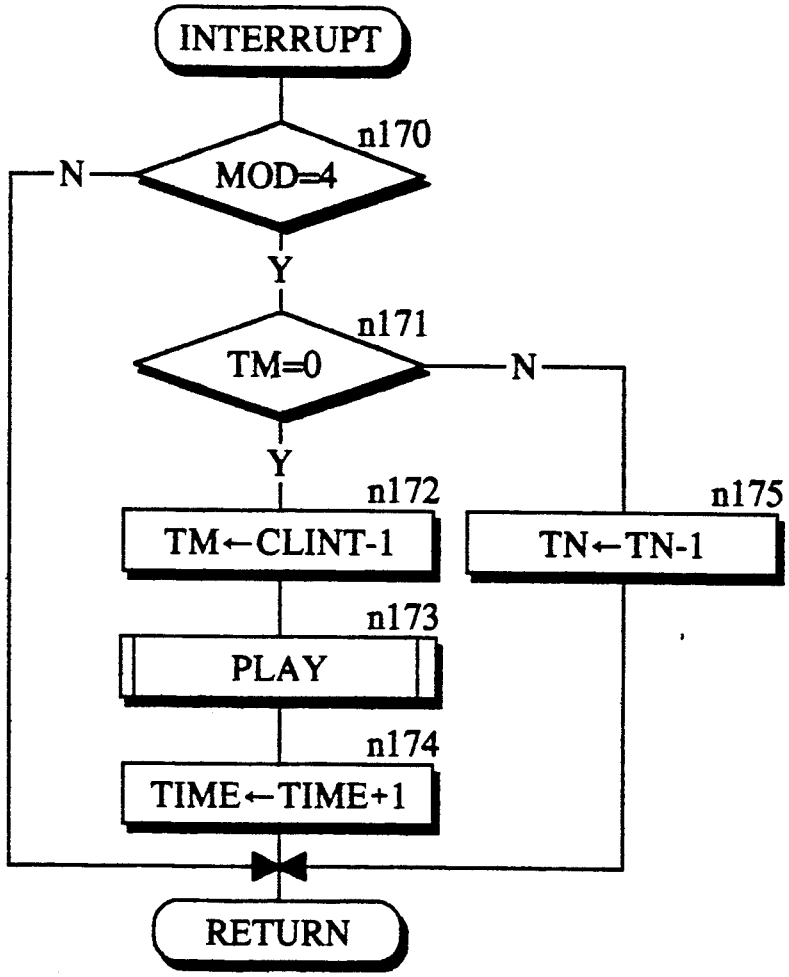

FIG. 15 is a flow chart of the timer interrupt process. This process is done every 10 micro seconds by an interrupt to the CPU. As this process is valid only in the play mode, a process in any mode other than the play mode returns with no operation at step n17O. With the play mode, the timer register TM is judged. If the timer register TM equals "0", that means the present timing equals clock timing (1/24 beat), so that new clock interval value CLINT-1 is set (n172), and the playing process is started (n173). Also, "1" is added to the free run counter TIME1 (n174). If TM doesn't equal "0", "1" is subtracted therefrom, and the process returns (n175).

Figure 16:
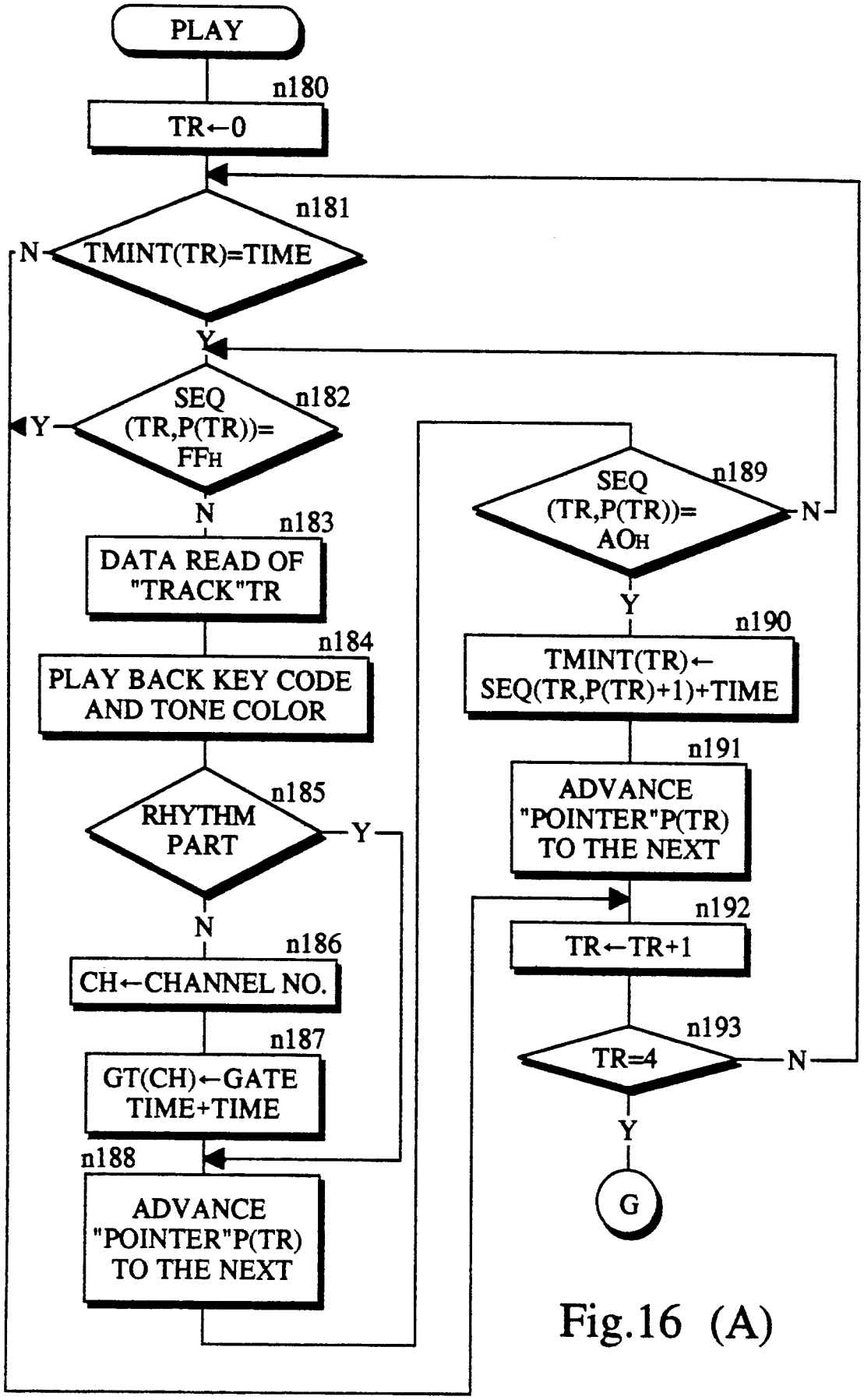
Figure 16B:
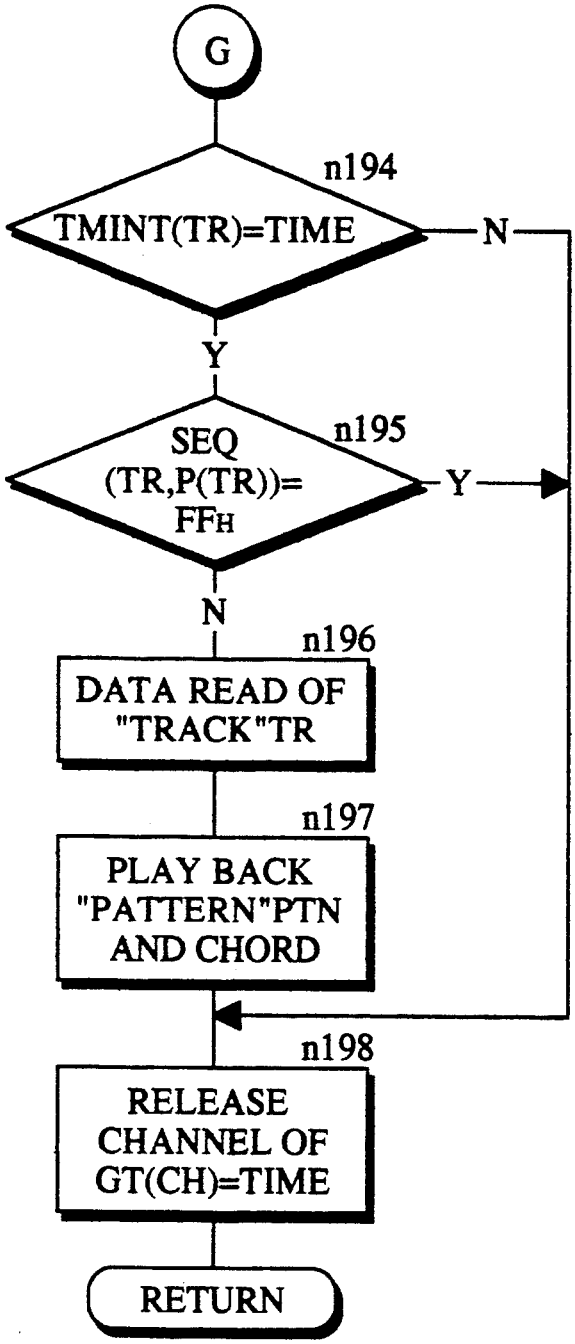

FIG. 16 is a flow chart showing the playing process. In this process, when the value of the free run counter TIME coincides with the tone generation timing TMINT(TR) for each sequence track, note data in the track to be generated is read (n180, n181, n192, n193). If the read data equals the end code data of "FFH", the process to the present track is skipped (n182). If the read data doesn't equal the end code data, the read data is "BOH" representing the note data. In this case, the following data is read (n183), and the key code, the tone color and so on are sent to the tone generator to execute a tone generation process (n184). If the generated tone isn't a rhythm part' tone, the tone generation length is set into the GT (CH) register (n185 to n187). The pointer P(TR) is incremented to read next data (n188). If the read data isn't "AOH" representing the time interval data, the process returns to step n182 to execute the above-mentioned process again (n189). If the read data is the time interval data, the data is added to the value of the free run counter, the sum of the addition being set into the tone generation timing register TMINT(TR) (n190), the pointer (PR) being advanced to the next event (n191).

The above-mentioned process is done to the tracks of TR=0 to 3. After that, similar process is applied to backing track to read and play back (n194 to n197). Finally, release step for tones elapsing tone generation time is done (n198), and the process returns.

In the put parts process of the above-mentioned example, already written data on a sequence track is replaced with part data. However, it is available to mix them to generate them simultaneously.

What is claimed is:

1. An instrument for recording and playing back musical playing data, comprising:
   - pattern storage means for storing pattern data of plural notes;
   - sequence storage means for storing sequence data of plural notes;
   - chord designation means for designating a chord;
   - transferring means for reading the pattern data from the pattern storage means, modifying the pattern data according to the chord designated by the chord designation means, and writing the modified pattern data as sequence data into the sequence storage means; and
   - playback means for reading the sequence data from the sequence storage means and using the read sequence data to generate a musical tone.

2. The instrument of claim 1 further comprising editing means for editing the sequence data stored in the sequence storage means.

3. The instrument of claim 1 further comprising playing order storage means for storing order data to specify playing order of the pattern data, and pattern playback means for reading the pattern data according to the stored order data and playing back the pattern data.

4. The instrument of claim 1 wherein the pattern storage means stores a plurality of pattern data and further comprising pattern designation means for designating pattern data in the pattern storage means, and wherein the transferring means modifies the designated pattern data and writes the modified pattern data into the sequence storage means.

5. The instrument of claim 1 further comprising position designation means for designating a position in the sequence storage means to be played back by the playback means, and wherein the transferring means writes the modified pattern data into the sequence storage means.

6. The instrument of claim 1 wherein the pattern data further comprises a plurality of parts each having an individual tone color.

7. The instrument of claim 6 further comprising part designation means for designating a part to be written, and wherein the transferring means writes the pattern data of the designated part into the sequence storage means.

8. An instrument for recording and playing back musical playing data, comprising:
   - pattern storage means for storing a plurality of pattern data of plural notes;
   - sequence storage means for storing sequence data of plural notes;
   - order storage means for storing order data to specify the order of different portions of the pattern data to be played;
   - chord designation means for designating a chord;
   - transferring means for reading the pattern data from the pattern storage means in order of the order data stored in the order storage means, modifying the read pattern data according to the chord designated by the chord designation means, and writing the modified pattern data as sequence data into the sequence storage means;
   - sequence playback means for reading the sequence data from the sequence storage means and playing back the read sequence data; and
   - pattern playback means for reading the pattern data in the order of the order data stored in the order storage means and playing back the read pattern data.

9. The instrument of claim 8 further comprising editing means for editing the sequence data stored in the sequence storage means.

10. The instrument of claim 8 further comprising chord designation means for designating a chord and wherein said transferring means further comprises modifying means for the pattern data according to the designated chord.

11. The instrument of claim 8 wherein the pattern data further comprises a plurality of parts each having an individual tone color.

12. The instrument of claim 11 further comprising part designation means for designating a part to be written, and wherein the writing means writes the pattern data of the designated part into the sequence storage means.

* * * * *